US009785983B2

(12) United States Patent
Zhao et al.

(10) Patent No.: US 9,785,983 B2
(45) Date of Patent: Oct. 10, 2017

(54) SYSTEM AND METHOD FOR DETECTING BILLING ERRORS USING PREDICTIVE MODELING

(71) Applicant: Opera Solutions U.S.A., LLC, Jersey City, NJ (US)

(72) Inventors: Qi Zhao, San Diego, CA (US); Andrew Kwok, San Jose, CA (US); Manjunatha Jagalur, Austin, TX (US); Eric Doi, Monterey Park, CA (US); Abhikesh Nag, San Diego, CA (US); Jacob Spoelstra, Redmond, WA (US)

(73) Assignee: Opera Solutions U.S.A., LLC, Jersey City, NJ (US)

( * ) Notice: Subject to any disclaimer, the term of this patent is extended or adjusted under 35 U.S.C. 154(b) by 0 days.

(21) Appl. No.: 13/917,308

(22) Filed: Jun. 13, 2013

(65) Prior Publication Data

US 2013/0339202 A1 Dec. 19, 2013

Related U.S. Application Data

(60) Provisional application No. 61/659,175, filed on Jun. 13, 2012.

(51) Int. Cl.
*G06Q 30/04* (2012.01)

(52) U.S. Cl.
CPC ..... *G06Q 30/04* (2013.01)

(58) Field of Classification Search
CPC ..... G06Q 30/04
See application file for complete search history.

(56) References Cited

U.S. PATENT DOCUMENTS

| | | | | |
|---|---|---|---|---|
| 7,136,448 | B1 * | 11/2006 | Venkataperumal et al. | 379/265.02 |
| 7,840,455 | B1 * | 11/2010 | Venkatasubramanian et al. | 705/30 |
| 8,355,934 | B2 * | 1/2013 | Virdhagriswaran | 705/4 |
| 2003/0233323 | A1 * | 12/2003 | Bilski et al. | 705/40 |
| 2004/0122764 | A1 * | 6/2004 | Bilski et al. | 705/40 |
| 2005/0144067 | A1 * | 6/2005 | Farahat et al. | 705/14 |
| 2005/0203777 | A1 * | 9/2005 | Rosenfeld et al. | 705/3 |
| 2008/0255900 | A1 * | 10/2008 | Lawrence et al. | 705/7 |
| 2011/0184766 | A1 * | 7/2011 | Virdhagriswaran | 705/4 |
| 2013/0073322 | A1 * | 3/2013 | Virdhagriswaran | 705/4 |
| 2013/0262357 | A1 * | 10/2013 | Amarasingham et al. | 706/21 |
| 2014/0188577 | A1 * | 7/2014 | Gerber | G06Q 10/06398 705/7.42 |

* cited by examiner

*Primary Examiner* — Mussa A Shaawat
(74) *Attorney, Agent, or Firm* — McCarter & English, LLP

(57) ABSTRACT

A system and method for detecting billing errors using predictive models is provided. The system includes a computer system and a billing error detection engine capable of detecting billing errors using predictive modeling techniques. The system receives and pre-processes billing information. The system then applies one or more predictive models to the information to identify billing errors. The results could be optionally sent to, and reviewed by, third party auditors, whereby their feedback could be incorporated into the results. A final report is generated by the system which indicates billing errors that require correction, thereby allowing an entity to correct such errors and prevent revenue leakage.

21 Claims, 8 Drawing Sheets

SYSTEM AND METHOD FOR DETECTING BILLING ERRORS USING PREDICTIVE MODELING

CROSS-REFERENCE TO RELATED APPLICATION

This application claims priority to U.S. provisional Patent Application No. 61/659,175 filed on Jun. 13, 2012, which is incorporated herein in its entirety by reference and made a part hereof.

BACKGROUND OF THE INVENTION

Field of the Invention

The present invention relates generally to systems for detecting errors. More specifically, the present invention relates to a system and method for detecting billing errors using predictive modeling.

Related Art

In the healthcare field, billing and coding are complex processes that involve multiple "handoffs" between various medical departments/entities, etc., as well as human intervention. Typically, when a patient visits a hospital, the doctor diagnoses the patient's symptoms and orders services to cure his/her illness or to alleviate symptoms. After the patient is discharged from the hospital, professional coders manually code the services and procedures provided to patients by reading physician orders, nurse notes, laboratory records, and many other medical records to prepare claims. This inevitably leads to billing errors or missed charges due to various reasons (e.g., misreading handwritten notes, delayed laboratory records, different billing rules for hospitals or insurance plans, inexperienced coders, etc.). As a result, there are direct losses associated with missing charges since hospitals (or other types of businesses) will not get paid by insurance companies or other payers. Further, claims with billing errors are also denied by payers. It has been estimated that about 1% of hospital revenue is lost due to the missing charges.

In order to prevent revenue leakage, most hospitals rely on manual review, and/or rule-based software solutions for checking bills before they are issued. Manual and rule-based solutions have difficulty handling different practice patterns across large systems (e.g., a large hospital system), which results in many exceptions and false-positives that may lead to denied claims due to billing errors, wasted time and resources, increased costs, etc. For pre-billing checks that are manually conducted, internal and/or third party reviewers review charges for a sample (10-15%) of pre-bill visits. Due to the expense of this approach, it is often reserved for only the most expensive procedures (e.g., surgeries, transplants, and cardiac procedures) and the review quality depends on the ability of the auditors (e.g., experience, training, etc.), who need to be constantly trained and educated on changes in medical care or billing.

Rule-based software solutions are mainly used to check for billing errors, instead of missing charges, and are often implemented as rules requiring the co-occurrence of specific procedure codes to check the consistency of claims. These solutions are only as effective as the rules created by the client, and usually the rules are too simple to capture the complicated patterns that exist in hospital billing, while the billing system as a whole becomes too complicated to maintain. For example, rule-based systems typically, and impractically, recommend hundreds of possible missing codes.

SUMMARY OF THE INVENTION

The present invention relates to a system and method for detecting billing errors using predictive models. The system includes a computer system and a billing error detection engine capable of detecting billing errors using predictive modeling techniques. The system receives billing information (e.g., in the form of a daily file and alert report), and pre-processes the billing information. The system then applies one or more predictive models to the information to identify billing errors. The results could be optionally sent to, and reviewed by, third party auditors, whereby their feedback could be incorporated into the results. A final report is generated by the system which indicates billing errors that require correction, thereby allowing an entity (e.g., a hospital) to correct such errors and to prevent revenue leakage. The system could apply more than one predictive model to detect errors, and can also cascade multiple models for increased performance.

BRIEF DESCRIPTION OF THE DRAWINGS

The foregoing features of the invention will be apparent from the following Detailed Description of the Invention, taken in connection with the accompanying drawings, in which.

DETAILED DESCRIPTION OF THE INVENTION

The present invention relates to a system and method for detecting billing errors using predictive modeling, as discussed in detail below in connection with FIGS. 1-8.

Figure 1:
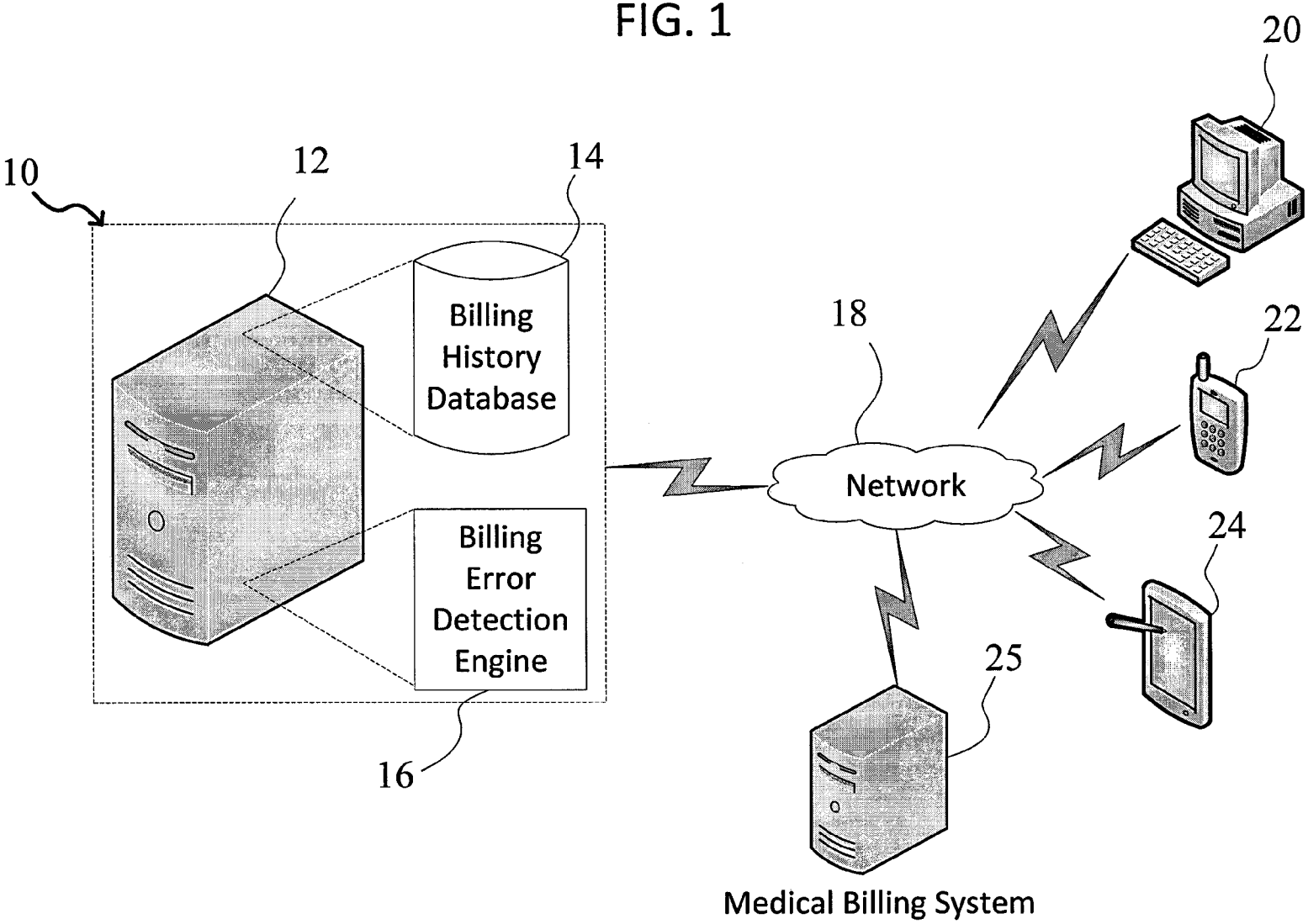
FIG. 1 is a diagram showing hardware and software components of the system for detecting billing errors.

FIG. 1 is a diagram showing the system of the present invention, indicated generally at 10. The system 10 includes a computer system 12 (e.g., a server) having a billing history database 14 stored therein and a billing error detection module or engine 16. The billing history database 14 could be stored on the computer system 12, or located externally therefrom (e.g., in a separate database server in communication with the system 10). As will be discussed in greater detail below, the billing error detection engine 16 applies one or more predictive models (discussed in detail below) to detect billing errors or missing charges, such as hospital billing errors or missing charges, so as to prevent revenue leakage. The system 10 could utilize historical patient/client billing data to train various statistical models that capture relationships, such as those between procedures, diagnoses, and any other billing codes. Further, the system 10 can prioritize missing charges, learn from feedback, and efficiently review every claim with computerized algorithms, both in pre- and post-bill review settings.

The system 10 can communicate through a network 18 with one or more clients, or auditors, to obtain daily file(s), obtain alert report(s), and/or transmit results. Network communication could be over the Internet using standard TCP/IP communications protocols (e.g., hypertext transfer protocol (HTTP), secure HTTP (HTTPS), file transfer protocol (FTP), secure file transfer protocol (SFTP), electronic data interchange (EDI), etc.), through a private network connection (e.g., wide-area network (WAN) connection, e-mails, electronic data interchange (EDI) messages, extensible markup language (XML) messages, file transfer protocol (FTP) file transfers, etc.), or any other suitable wired or wireless electronic communications format.

The computer system 12 could be any suitable computer server (e.g., a server with an INTEL microprocessor, multiple processors, single processing core, multiple processing cores, etc.) running any suitable operating system (e.g., Windows by Microsoft, Linux, UNIX, etc.). The computer system 12 includes non-volatile storage which could include disk storage (e.g., hard disk), flash memory, read-only memory (ROM), erasable, programmable ROM (EPROM), electrically-erasable, programmable ROM (EEPROM), or any other type of non-volatile memory. The computer system 12 could further include random access memory (RAM). The engine 16, discussed in greater detail below, could be embodied as computer-readable instructions stored in computer-readable media (e.g., the non-volatile memory mentioned above), and programmed in any suitable programming language (e.g., C, C++, Java, MATLAB, Python, Fortran, etc.). The server could also include a display and one or more input devices (e.g., keyboard, mouse, etc.).

The system 10 could be web-based and could allow for remote access to the system 10 over the network 18 by one or more devices, such as a personal computer system 20, a smart cellular telephone 22, a tablet computer 24, or other devices. It is possible that the billing error detection engine 16 could execute locally on the personal computer 20, smart cellular telephone 22, and/or tablet computer 24. It is conceivable that, in such circumstances, the device could communicate with a remote billing database over a network 18. Further, as noted above, the billing history database 14 need not be stored on the server 12, and indeed, billing data could be provided from one or more remote data sources, such as from a medical billing system 25 (e.g., associated with a hospital or other entity).

Figure 2:
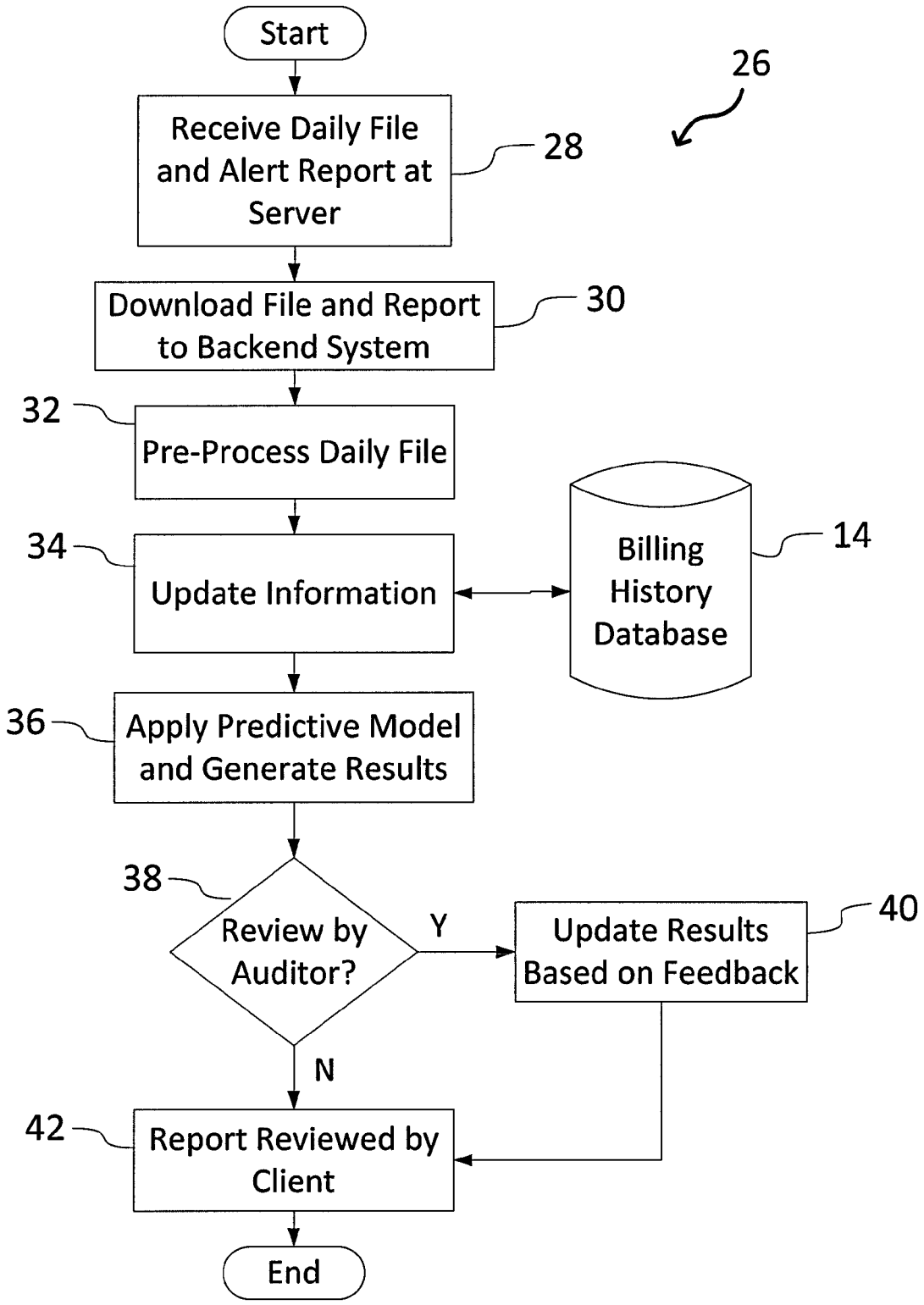
FIG. 2 is a flowchart showing overall processing steps carried out by the system.

FIG. 2 is a flowchart showing overall data flow processing steps 26 carried out by the billing error detection engine 16 of FIG. 1. Beginning in step 28, the system 10 receives a daily file and alert report from a billing client (e.g., a hospital, other entity, etc.). The client generates the alert report (e.g., using a rule-based system), which is used by the system 10 to de-duplicate recommendations. In step 30, the daily file and alert report could be downloaded from the server 12 to a backend system, or processed directly by the system 12. In step 32, the daily file is pre-processed to select the useful data fields as inputs for the billing error detection engine 16. By way of non-limiting illustration, examples of inputs for a hospital system are shown in Table 1, below:

TABLE 1

| |
|---|
| COID (Hosptial ID) |
| STAY (Total hours between patient's admission and discharge) |
| PAT_TYPE (Patient's major type) |
| PAT_SUBTYPE (Patient's subtype) |
| ER_ADMIT_FLAG (Flag indicating admission through ER) |
| PAT_FC_CD (Patient's financial class or payer class) |
| AGE (Patient's age) |
| SEX (Patient's sex) |
| HCPC_CODE (HCPCS codes) |
| PROC_CODE (ICD9 Procedure codes) |
| DIAG_CODE (ICD9 Diagnosis codes) |
| CHARGE_CODE (Hospital internal charge codes) |
| WEEKDAY_D (The day of week of the account's discharge date) |
| NUM_CHGS (The number of charges existing on the account) |
| BAL (The total balance on the account) |

In step 34, the backend system uses the daily file to update the information in the billing history database 14. Then, in step 36, the backend system applies one or more predictive models to the updated information to detect billing errors in the daily file, and generates results. In step 38, the user, client, or system 12 decides whether the results of step 36 require review by an auditor (e.g., third party auditor). If so, in step 40 the results of the predictive model are updated based on the feedback of the auditors. Otherwise, the process proceeds to step 42, where the results are made accessible to, and reviewed by, the client.

Figure 3:
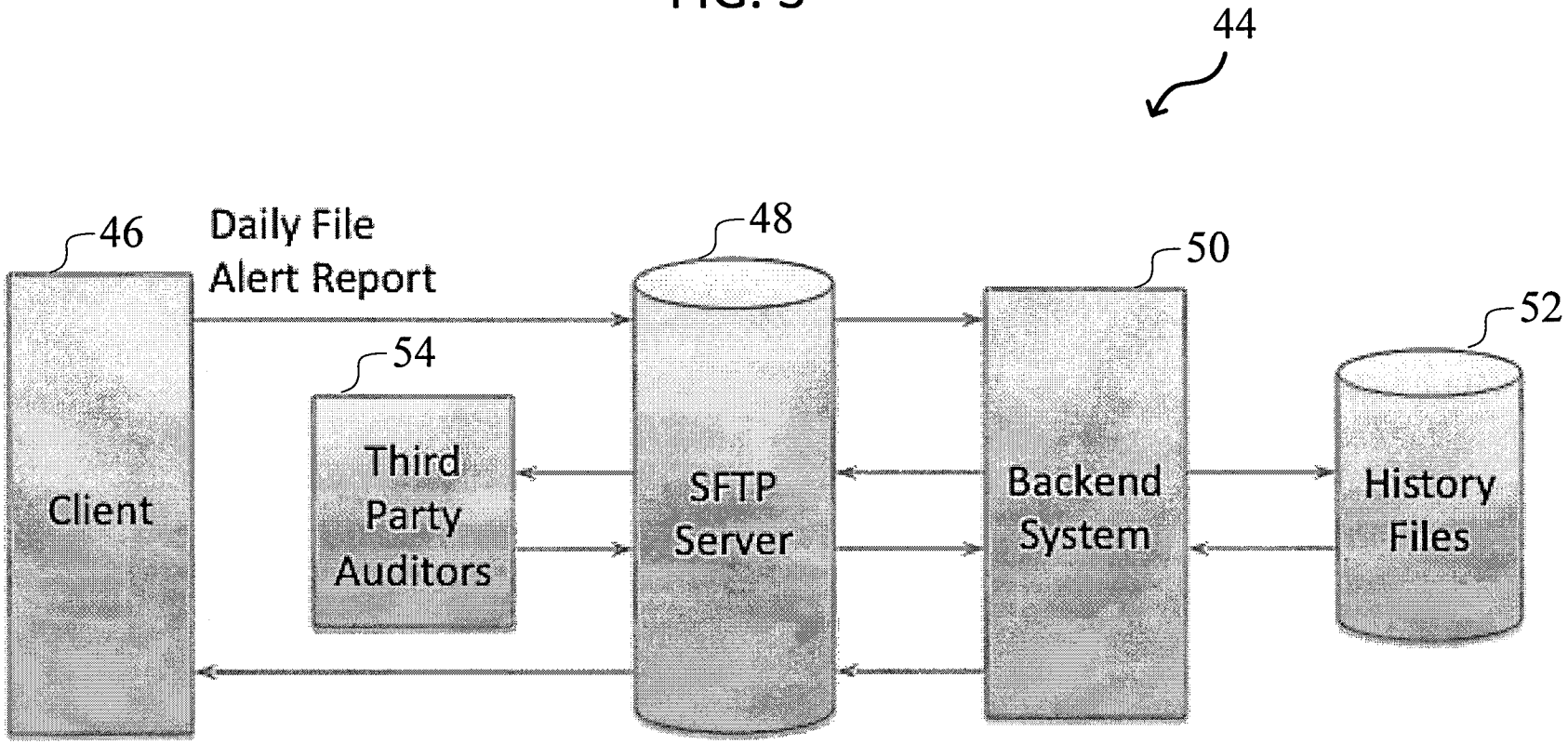
FIG. 3 is a diagram illustration a file-based implementation of the system.

It is noted that the system 10 could be implemented as a file-based system (e.g., wherein billing files are periodically transmitted to the system 10 for processing), or as a database-based system (e.g., wherein billing information is stored in a database accessible to the system 10, such as the billing history database 14, and/or a database in the medical billing system 25 of FIG. 1). An example of a file-based implementation, indicated generally at 44, is shown in FIG. 3. In this implementation, the client 46 sends the daily file and alert report to an SFTP server 48. The billing error detection engine of the present invention could be implemented in a "backend" computer system 50. The computer system 50 downloads the daily file and alert report, and then retrieves data or information (e.g., the complete history for each visit) from the previous history file (e.g., from a flat file). A history file 52 (which could be a flat file, database, etc.) is updated with the most recent daily file. The backend system 50 applies one or more predictive models to the data from the updated history file to detect billing errors in the file. The results could be saved into a Comma Separated Value (CSV) file, an example of which is shown in Table 2 below:

TABLE 2

| COID | Account | Code Type | Code | Charge Code | Quantity | Charge Amount DT | Description | Response (Y/N) | Quantity change | Comments |
|---|---|---|---|---|---|---|---|---|---|---|
| 831 | xxxxxxx | AGE | 75 | | | | | | | |
| 831 | xxxxxxx | SEX | F | | | | | | | |
| 831 | xxxxxxx | ADMIT DATE | 1/10/2012 | | | | | | | |

TABLE 2-continued

| COID | Account | Code Type | Code | Charge Code | Quan-tity | Amount | Charge DT | Description | Re-sponse (Y/N) | Quan-tity change | Comments |
|---|---|---|---|---|---|---|---|---|---|---|---|
| 831 | xxxxxxx | DISCHARGE DATE | 1/30/2012 | | | | | | | | |
| 831 | xxxxxxx | INSURANCE CLASS | F | | | | | HMO | | | |
| 831 | xxxxxxx | PATIENT TYPE | O | | | | | OUTPATIENT | | | |
| 831 | xxxxxxx | PATIENT SUBTYPE | 6 | | | | | SWING BED | | | |
| 831 | xxxxxxx | ADMIT DIAGNOSIS | V6889 | | | | | ADMINISTRTVE ENCOUNT NEC | | | |
| 831 | xxxxxxx | PRIM DIAGNOSIS | V6889 | | | | | ADMINISTRTVE ENCOUNT NEC | | | |
| 831 | xxxxxxx | Charge (CHARGE) | | 413-10049 | 40 | 336.4 | 1/30/2012 | GUEST TRAY [IMAGING CENTER - ULTRASOUND] | | | |
| 831 | xxxxxxx | Charge (CHARGE) | 97803 | 413-97015 | 3 | 271.89 | 1/26/2012 | MED NUT THRP-RE-ASSESS-15MIN [IMAGING CENTER - ULTRASOUND] | | | |
| 831 | xxxxxxx | Charge (CHARGE) | | 413-99217 | 20 | 168.2 | 1/30/2012 | MEAL TRAY [IMAGING CENTER - ULTRASOUND) | | | |
| 831 | xxxxxxx | Charge (CHARGE) | 71020 | 428-71020 | 1 | 154.85 | 1/15/2012 | CHEST PA & LATERAL [RADIOLOGY - DIAGNOSTIC] | | | |
| 831 | xxxxxxx | Charge (CHARGE) | 80048 | 436-10606 | 8 | 714.08 | 1/29/2012 | METABOLIC PANEL BASIC CA TOTAL [LABORATORY] | | | |
| 831 | xxxxxxx | Charge (CHARGE) | 80053 | 436-10607 | 2 | 363 | 1/24/2012 | COMPREHENSIVE METABOLIC PANEL [LABORATORY] | | | |
| 831 | xxxxxxx | Charge (CHARGE) | 80076 | 436-10608 | 1 | 86.28 | 1/12/2012 | HEPATIC FUNCTION PANEL [LABORATORY] | | | |
| 831 | xxxxxxx | Charge (CHARGE) | 80074 | 436-10694 | 1 | 307.94 | 1/12/2012 | ACUTE HEPATITIS PANEL [LABORATORY] | | | |
| 831 | xxxxxxx | Charge (CHARGE) | 86900 | 436-208 | 1 | 110.1 | 1/14/2012 | ABO GROUP [LABORATORY] | | | |
| 831 | xxxxxxx | Charge (CHARGE) | 86901 | 436-224 | 1 | 71.41 | 1/14/2012 | BLOOD TYPING RH (D) [LABORATORY] | | | |
| 831 | xxxxxxx | Charge (CHARGE) | 84134 | 436-2756 | 2 | 178.52 | 1/17/2012 | PREALBUMIN [LABORATORY] | | | |
| 831 | xxxxxxx | Charge (CHARGE) | 36415 | 436-36111 | 11 | 163.68 | 1/29/2012 | VENIPUNCTURE ROUTINE [LABORATORY] | | | |
| 831 | xxxxxxx | Charge (CHARGE) | 85014 | 436-513 | 1 | 32.6 | 1/15/2012 | HEMATOCRIT [LABORATORY] | | | |
| 831 | xxxxxxx | Charge (CHARGE) | 85018 | 436-80085 | 1 | 32.6 | 1/15/2012 | HEMOGLOBIN [LABORATORY] | | | |
| 831 | xxxxxxx | Charge (CHARGE) | 85025 | 436-85028 | 4 | 217.32 | 1/29/2012 | CBC COMPLETE AUTOMATED [LABORATORY] | | | |
| 831 | xxxxxxx | Charge (CHARGE) | 85044 | 436-85044 | 1 | 33.96 | 1/14/2012 | RETICULOCYTE COUNT [LABORATORY] | | | |
| 831 | xxxxxxx | Charge (CHARGE) | 86850 | 436-86017 | 1 | 102.65 | 1/14/2012 | ANTIBODY SCREEN RBC [LABORATORY] | | | |
| 831 | xxxxxxx | Charge (CHARGE) | 85027 | 436-98801 | 3 | 187.44 | 1/18/2012 | CBC NO DIFF [LABORATORY] | | | |
| 831 | xxxxxxx | Charge (CHARGE) | 86920 | 458-33137 | 2 | 223.14 | 1/14/2012 | CROSSMATCH 1 UNIT [BLOOD BANK] | | | |
| 831 | xxxxxxx | POSSIBLY MISSING CODES | P9016 | 458-9958 | | | | LEUKO DEPLETED RBCS PROCESSING [BLOOD BANK] | | | |
| 831 | xxxxxxx | OTHER DISCOVERED | | | | | | | | | |

Optionally, the computer system 12 could upload the results to one or more third party auditors 54 which review the results and fill in, or correct, codes or information as needed. The reviewed results are then sent back to the server 48 and in turn to the backend system 50 which consolidates or integrates the reviewed results. In either case, the final results are then sent from the SFTP server 48 to the client 46 for review.

Figure 4:
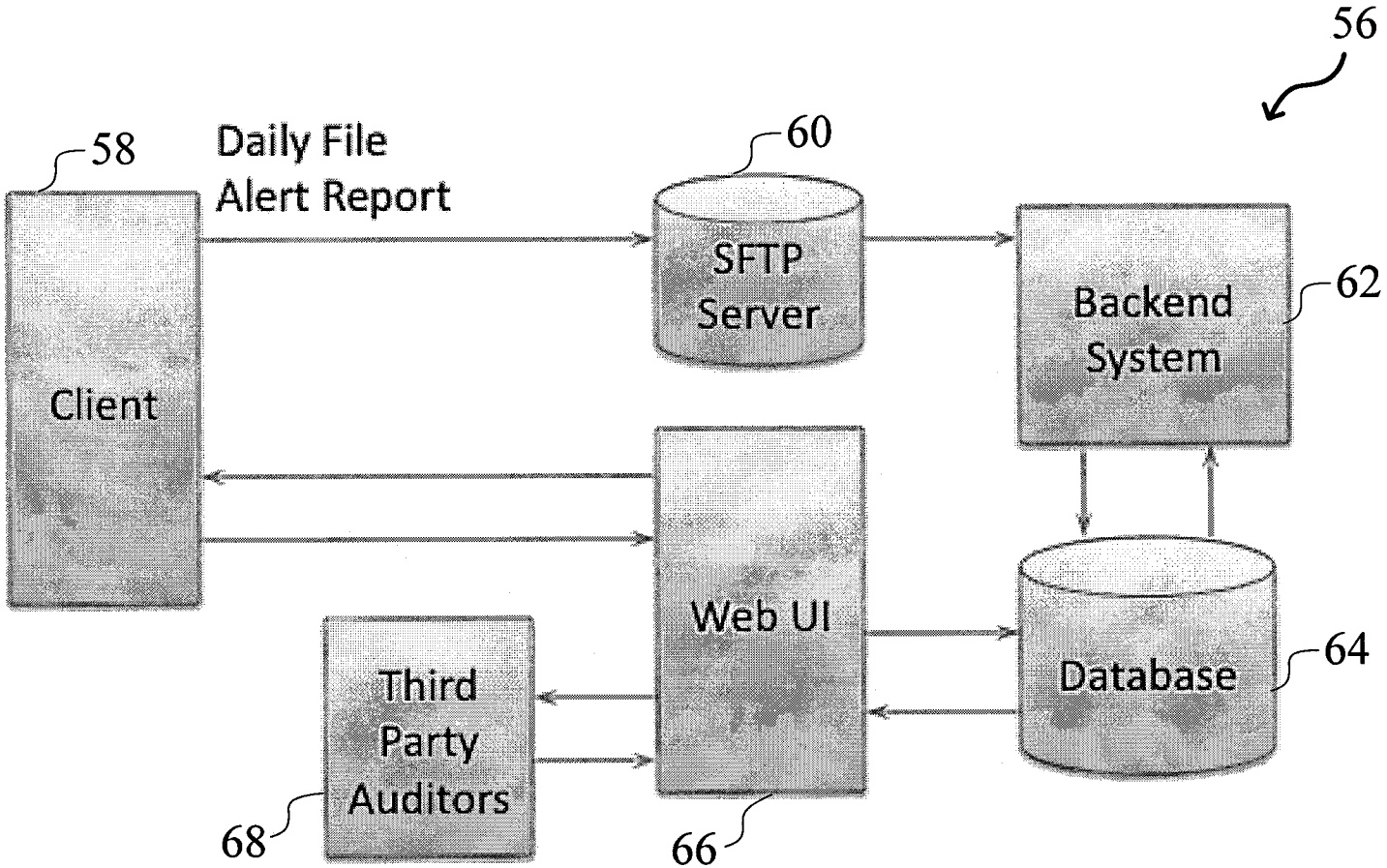
FIG. 4 is a diagram illustrating a database-based implementation of the system.

FIG. 4 is a diagram illustrating a database-based implementation of the system, indicated generally at 56. In the database-based implementation 56, a client 58 sends the daily file and alert report to an SFTP server 60, and the daily file and alert report are then downloaded by a backend system 62 which includes the billing error detection engine 14 of FIG. 1. The backend system 62 updates a billing history database 64 with the most recent daily file, applies one or more predictive models to the billing history database 64 to detect billing errors, and then saves the results to the database 64. The results can be reviewed, and feedback filled in, by a third party auditor 68, a client's internal auditor, and/or the client 58 through a web user interface 66, so that any feedback can be saved to the database 64.

Figure 5:
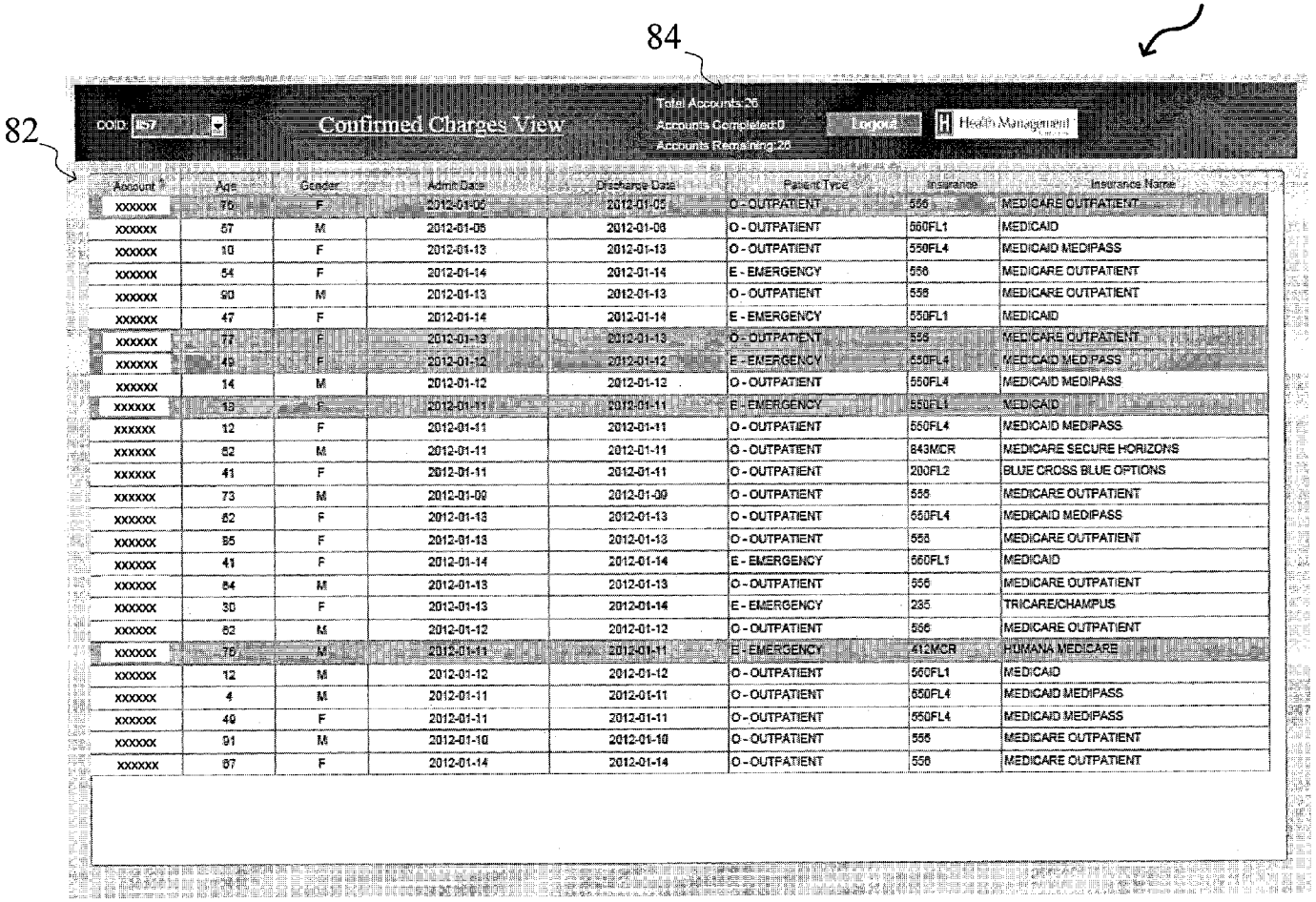
FIGS. 5-6 are screenshots showing a web-based user interface generated by the system.
Figure 6:
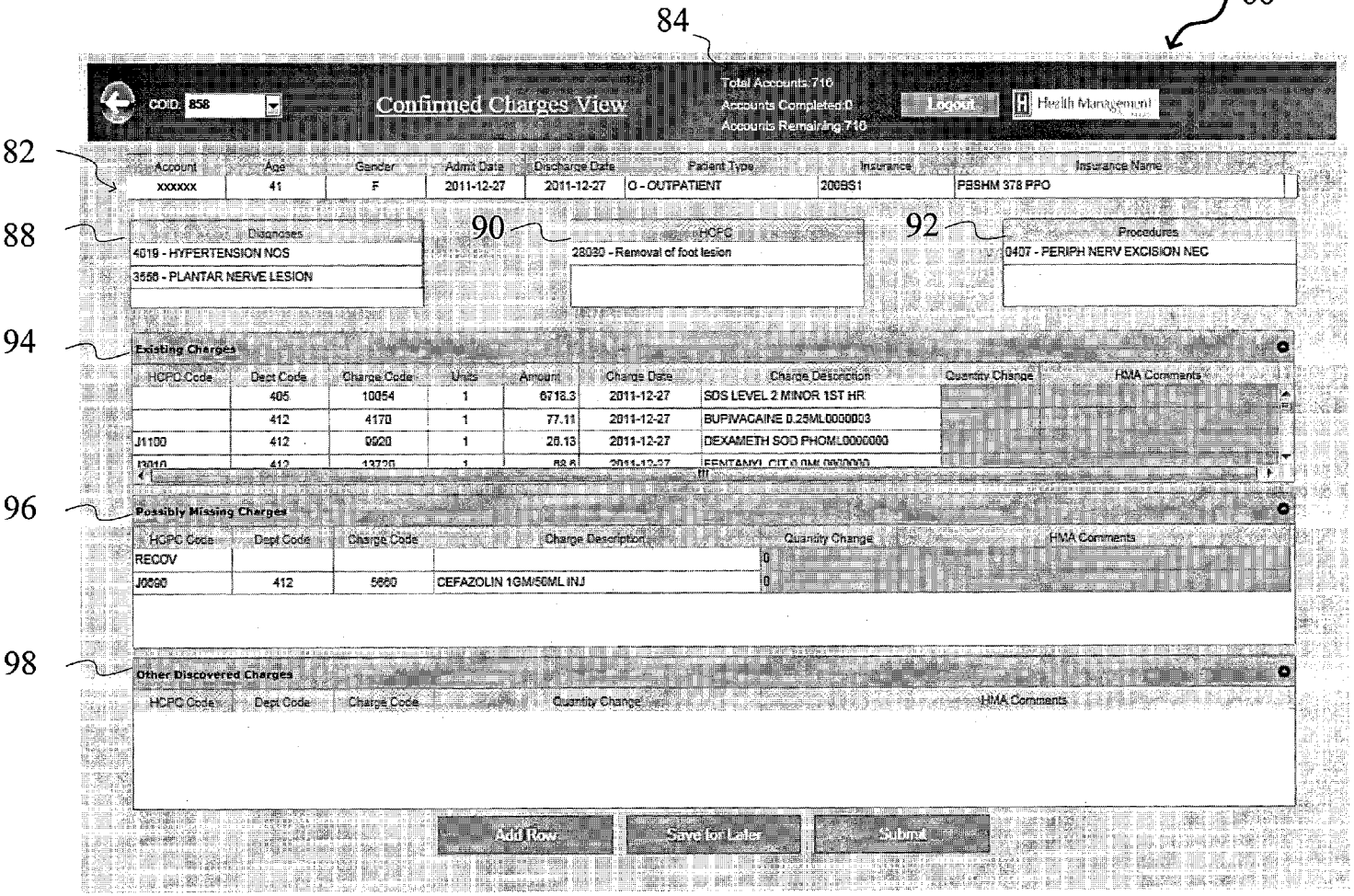

FIGS. 5-6 are screenshots showing a web-based user interface 66 generated by the present invention. As shown in FIG. 5, the interface 66 displays sortable basic summary information 82 relating to billing records to be processed by the system, including account number and information about a patient associated with the account, such as age, gender, date of admission, date of discharge, patient type (e.g., outpatient or emergency), insurance type, and insurance name. Status information 84 is also displayed, including the total number of accounts, the number of accounts completed, and the number of accounts remaining. The account number, or other information, could be hyperlinked so that clicking on it will bring up detailed account information, as shown in FIG. 6.

Referring to FIG. 6, the user interface 66 displays basic summary information 82 and model status information 84, as well as more detailed information about a billing record such as diagnoses 88, Healthcare Common Procedure Coding System (HCPCS) codes 90, procedures 92 (other than HCPCS procedures), existing charges 94, possible missing charges 96, and other discovered charges 98. Importantly, the information displayed in the user interface 66 automatically identifies missing or incomplete billing information, thereby allowing a user of the system (e.g., a hospital administrator, etc.) to correct such bills and to prevent lost revenue.

Figure 7:
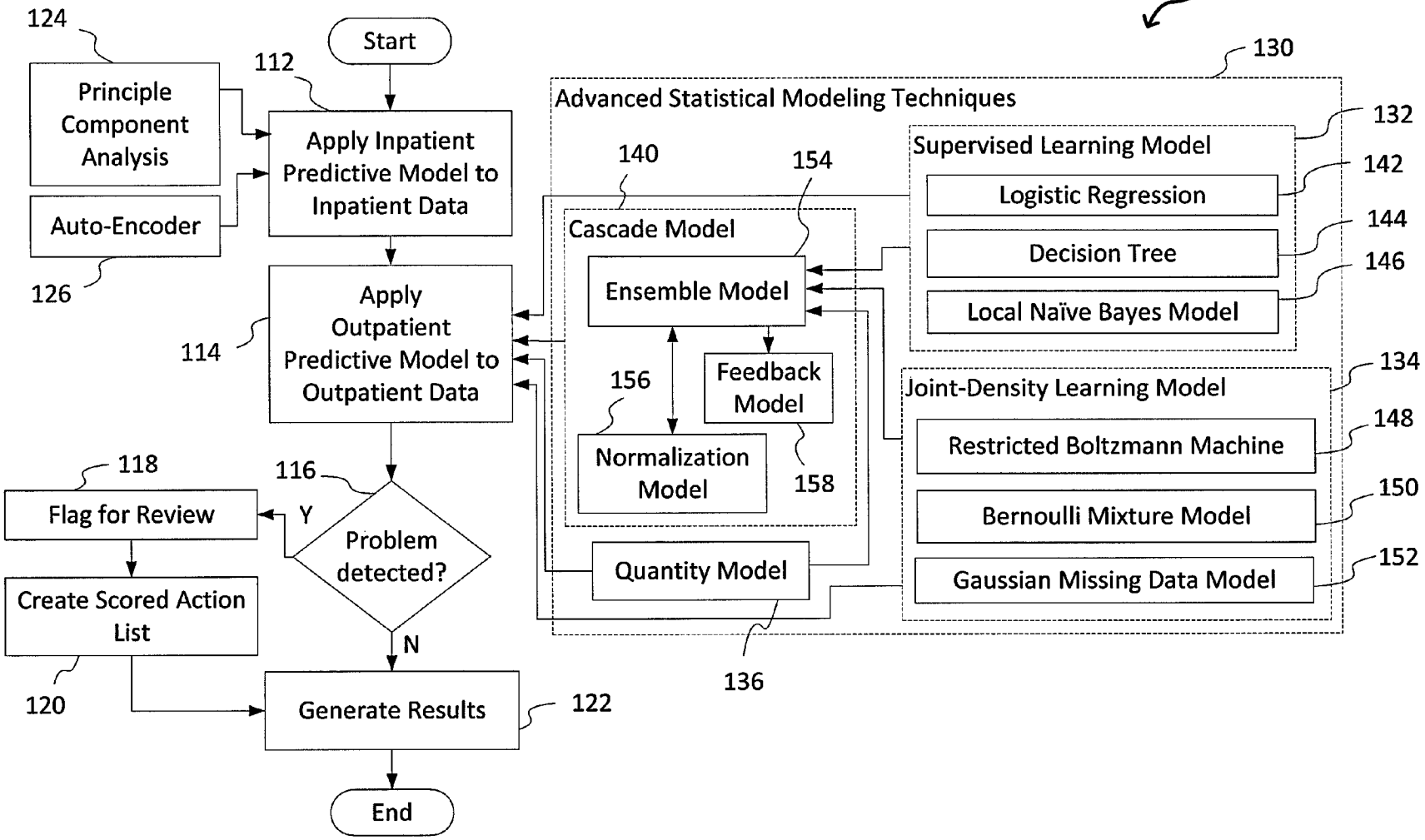
FIG. 7 is a flowchart showing processing steps carried out by the system for detecting billing errors using one or more predictive models.

FIG. 7 is a flowchart showing processing steps 110 according to the present invention for detecting billing errors using one or more predictive models. Beginning in steps 112 and 114, the system applies one or more inpatient predictive models to inpatient data, and one or more outpatient predictive models to outpatient data. Steps 112 and 114 are depicted as occurring sequentially, but it is noted that these steps could occur in reverse order or in parallel. Each model can detect potential problems in billing data, and can score the data for comparison purposes. For example, higher scores correspond to higher chances of having a miscoding or a missing charge. Upon detection of a problem in step 116 (e.g., unusual combination of codes for a particular visit), the system flags the billing record for review in step 118, and creates a scored action list in step 120 that prioritizes both the amount to be added and likelihood that there is a problem. In step 122, the system generates results, e.g., displays a report summarizing detected billing errors (such as shown in FIG. 6).

Importantly, the system can use different statistical models for inpatient data and outpatient data to accommodate differences in payment methodologies. For example, major inpatients can be billed using the Perspective Payment System (PPS), where the reimbursement to hospitals is based on Diagnosis Related Groups (DRGs). Usually the primary diagnosis, surgical procedures, and/or complications and comorbidities, are used to assign each discharged patient into a DRG. Hospitals are reimbursed by a fixed amount for the same DRG no matter what charges were made during a patient's hospital stay. As a result, the inpatient models target two types of outliers: extremely low charges and extremely high charges for a certain DRG. Extremely low charges due to billing errors may not result in more reimbursement for the potential missing charge because reimbursement is a fixed amount, but those errors could lower the average charges for the DRG, which could eventually lower the payment set up for that DRG. For extremely high charges, the patient could be classified into a different DRG, which could potentially have a higher reimbursement pay rate.

One methodology that could be applied to inpatient data is Principle Component Analysis (PCA) 124. Every patient visit has charges associated with it and each charge has a department code assigned to it. All the charge level data can be "rolled up" and cumulative charges for each department can be used as the input variables for the PCA 124. An example of cumulative charges is shown in Table 3 below.

TABLE 3

| Visit # | Hospital # | Discharge Date | Financial Code | Dept_566 | Dept_467 | Dept_other | Total |
|---|---|---|---|---|---|---|---|
| xxxxxxx | 803 | Feb. 11, 2010 | Medicare | $4,889 | $17,345 | $2,987 | $25,221 |
| xxxxxxx | 808 | Feb. 11, 2010 | HMO | $1,023 | $21,098 | $6,778 | $28,899 |

For better performance, PCA 124 can optionally be applied not directly to the charge values, but to the logarithmic values of the charges. PCA 124 is not robust with extreme outliers, so to improve results, the number of visits for each DRG can be filtered before applying PCA 124, such that if $\mu$ is the mean and $\sigma$ is the standard deviation of the distribution of $\log(\Sigma_n \text{ charges})$, only visits that have $(\mu-1.5\sigma) < \log(\Sigma \text{ charges}) < (\mu+1.5\sigma)$ are retained.

For each DRG, PCA 124 is applied to data over one year, and then eigenvalues and eigenvectors are computed. The eigenvalues are sorted in descending order and the bottom 20% of the eigenvalues are used to calculate the Mahalanobis distance $\Sigma_{i=n}^{l} p^2/\lambda$, where l is the total number of principal components, n is the index of the first eigenvalue after the top 80%, p is the value of the $i^{th}$ principal component for the record and $\lambda$ is the corresponding $i^{th}$ eigenvalue. The Mahalanobis distance represents the score of the visit (i.e., error term or relative error for a visit).

Each new visit is converted to the same format and scored using the set of eigenvectors obtained for the DRG to which it belongs. After scoring, the data for the new visits is reconstructed using the top 80% eigenvectors and the mean and standard deviation of the log values of the department level charge distributions. The original department-hospital level average and reconstructed values are compared and the department with the highest difference is ranked 1 (and, so on) for each visit. The first ranked entry is considered to be the charge value with highest priority review for that visit. This predicts charging errors at the department level, but not individual missing charges for inpatient scoring. However, department and revenue codes can be combined to give a more granular estimate of missing charges.

Another methodology that could be applied to inpatient data is an auto-encoder 126, which is a nonlinear extension of PCA 124 and can explore the nonlinearity in the data and can also accept binary and categorical inputs. The auto-encoder 126 is preferably a multi-layer, artificial neural network with special structure. The neural network includes an input layer, a number of considerably smaller hidden layers which will form the encoding, and an output layer where each neuron (or, processing element) has the same meaning as in the input layer. Similar to PCA 124, the trained auto-encoder 126 is applied to the new patient visits to reconstruct the charge values in the department level (or combined department and revenue code level). If the difference between the actual value and reconstructed value is above a certain threshold, it should be reviewed for auditors.

For outpatient data, hospital reimbursement is based on fees charged for service (the most traditional payment mechanism), which means that a service is billed using a procedure code (e.g., HCPCS, current procedural terminology (CPT), International Classification of Diseases, Ninth Revision, Clinical Modification (ICD-9-CM), etc.). The payer has a fee schedule with a set reimbursement amount for each service. The provider receives the fee schedule amount less any deductible or co-insurance owed by the patient. The outpatient predictive models, or advanced statistical modeling techniques 130, directly detect the missing codes, resulting in more reimbursement for hospitals. Exemplary outpatient predictive models, or advanced statistical modeling techniques 130, include, but are not limited to, supervised learning models 132, joint density learning models 134, quantity model 136, and cascade models 140. For at least some of these models, L1-regularization could be used to reduce over-fitting of training data.

The supervised learning model 132 learns the relation between data and their labels (e.g., charge codes). For instance, assume is the total number of codes, and the patient visit data is represented as a binary vector $x=(x_1, \ldots, x_D)$, such that $x_i=1$ if code i is present and $x_i=0$ otherwise (where code i could represent a charge code, diagnosis code, procedure code, or any other code). For any code i, the supervised learning model 132 learns the probability of the presence of that code $p(x_i|x_{-i})$, where $x_{-i}=(x_1, \ldots, x_{i-1}, x_{i+1}, \ldots, x_D)$ is the rest of the codes. Supervised learning models 132 that could be used include, but are not limited to, logistic regression models 142, decision tree models 144, and local Naïve Bayes models 146.

For logistic regression (LR) 142 the model assumes:

$$p(x_i \mid x_{-i}) = \frac{1}{1 + e^{b+w^T x_{-i}}} \qquad \text{Equation 1}$$

Here, b is the prior bias and w is a vector of weights that correspond to how each individual feature in $x_{-i}$ influences the probability of having $x_i$. As such, the LR model 142 is trained for each potentially missing charge code. Often, the ratio of positive to negative training examples is very small. The number of negative visits should be down-sampled to ensure that the logistic regression training can learn properly. The charge codes are chosen based on frequency in the data as well as dollar value. Preferably, codes are chosen that appear often enough to train an accurate model, and whose dollar value is high enough.

The number of LR models 142 built depends on the number of codes that need to be evaluated (e.g., six thousand models). Patient data is scored by each individual LR model 142, and the probability of missing codes is calculated according to the formula above, which could be one of the inputs of the ensemble model 154, discussed in more detail below.

Decision tree (DT) models 144 can capture the nonlinearity between data and their labels. Unlike the LR model 142, the DT model 144 can be constructed to take into account multiple hospitals (e.g., 32,000 decision tree models can be constructed). Here, the probability $p(x_i|x_{-i})$ is modeled as a decision tree, which consists of decision nodes and leaf nodes. Each of the decision nodes consists of the feature used to split the node, and links to other nodes based on presence or absence of the feature in a given test case. Each leaf node consists of probability of the presence of code.

The decision tree is constructed by minimizing entropy, which is defined as $-\Sigma_x p(x) \log p(x)$. At the root node, the feature that minimizes entropy of the label is selected. The samples are then split into two groups based on the value of the split feature and recursively subsequent nodes are created. The process stops when there are insufficient samples to proceed or the entropy reduction is not substantial. At every leaf node, the probability of the label is calculated as (number of positive labels)/(number of labels), and stored. During scoring, the decision tree is traversed according to the values of the decision features, and when a leaf node is reached, the label probability associated with that leaf node is returned.

The Local Naïve Bayes Model 146 is another supervised learning model 132 that creates neighborhoods for each visit and applies the standard Naive Bayes Model on the neighborhoods to recommend the missing codes for that visit. Compared with LR models 142 and DT models 144, this method is dynamic but sacrifices some model performance.

In order to determine the neighborhood for each visit, the similarity between visits must be defined. Since each visit can be represented as the set of codes associated with it, the cosine distance can be used as the similarity. For any two sets A, B, the similarity between them is:

$$s(A, B) = \frac{|A \cap B|}{\sqrt{|A||B|}} \qquad \text{Equation 2}$$

Different weights can be assigned to the diagnosis codes, procedure codes, and HCPCS codes when computing the similarity. For example, the similarity score between two visits (x, y) in one of the algorithms can be:

$$\mathrm{Sim}(x, y)=s(H(x),H(y))+S_1 \cdot s(D(x), D(y))+S_2 \cdot s(P(x),P(y)) \qquad \text{Equation 3}$$

where $S_1, S_2>0$ are arbitrary constants, $H(\cdot)$,$D(\cdot)$, and $P(\cdot)$ are the HCPCS codes, diagnosis codes, and procedure codes of visits, respectively. Finally, the neighborhood of each visit is the first K neighbors with the highest scores.

The Naïve Bayes Model 146 is then used to estimate the probability $p(x_i|x_{-i})$:

$$p(x_i = 1 \mid x_{-i}) = \frac{p(x_i = 1)\prod_{j \neq i} p(x_j \mid x_i = 1)}{p(x_{-i})} \quad \text{Equation 4}$$

The ratio of the two probabilities is then used to remain numerically stable:

$$\frac{p(x_i = 1 \mid x_{-i})}{p(x_i = 0 \mid x_{-i})} = \frac{p(x_i = 1)\prod_{j \neq i} p(x_j \mid x_i = 1)}{p(x_i = 0)\prod_{j \neq i} p(x_j \mid x_i = 0)} \quad \text{Equation 5}$$

Each term on the right side is calculated from the neighborhood using a Laplace smoothing. With this ratio, a threshold test is performed to determine how much more probable it is that the potentially missing code $x_i$ should be in visit $x_{-i}$.

As discussed above, a joint-density learning model 134 can be applied to outpatient data. Rather than receiving an explicit label for missing charges (as in the supervised learning models 132 discussed above), the joint-density learning model 134 tries to learn the complex interdependencies between charge codes, diagnosis codes, and other informative visit data without a predetermined notion of what is "right" or "wrong." Here the binary vector $x=(x_1, \ldots x_D)$ is still used to represent the presence of charge codes, diagnoses codes, and procedure codes as well as any other patient visit data. Three exemplary joint-density learning models 134 are the Restricted Boltzmann Machine model 148, the Bernoulli Mixture Model 150, and the Gaussian Missing Data model 152.

The Restricted Boltzmann Machine model (RBM) 148 draws from statistical thermodynamics to compute whether or not a particular charge code should be present. The RBM 148 consists of two layers: the visible layer $x=(x_1, \ldots, x_D)$ whose units represent patient visit data, and the hidden layer $h=(h_1, \ldots, h_n)$ whose units are linked to the units of the visible layer. The model functions in two stages: (1) visible units trigger the state of the hidden units; and (2) the hidden units re-trigger the states of the visible units. The visible and hidden units are triggered stochastically. Each hidden unit is triggered according to the following probability distribution:

$$p(h_j = 1 \mid x) = \frac{1}{1 + e^{b_j + W^j x}} \quad \text{Equation 6}$$

Here, $b_j$ is the bias of hidden unit j and $W^j$ is the set of weights that represent the influence that the visible nodes x have on the behavior of hidden node $h_j$. Visible nodes are triggered according to the distribution:

$$p(x_i = 1 \mid h) = \frac{1}{1 + e^{a_i + h^T W_i}} \quad \text{Equation 7}$$

Similar to the notation for hidden node activation, $a_i$ is the bias for visible unit i and $W_i$ is the set of weights that influence the activation of visible node i with respect to the hidden states h. The weights $W_i$, $W^j$ are columns and rows, respectively, of the same weight matrix W.

Patient visit data is grouped first according to hospital, then according to primary diagnosis code. Thus, the RBMs 148 are trained on a very local level of data. The diagnosis groups are chosen such that each group has roughly the same number of training examples. Within each diagnosis group, the visits are converted into the binary vector x and are used as examples from which the RBM 148 can learn. For scoring, the appropriate RBM 148 model is selected according to the hospital and primary diagnosis. Then, the patient data is converted to binary form. This input is passed into the model, which undergoes the two stages described above. Any new re-triggered visible nodes indicate a high probability of missing charges.

The Bernoulli Mixture Model (BMM) 150 is a special mixture model with the assumption that the binary data points for each component are generated by a Bernoulli distribution. Similar to the other methods, each patient visit is formulated as a binary vector $x=(x_1, \ldots, x_D)$. The hidden variable is a multinomial label $z \in \{1, 2, \ldots, k\}$ that can be viewed as assigning each visit vector to one of k clusters. The joint distribution of the BMM 150 is given by:

$$\begin{aligned} p(x, z \mid \pi, \mu) &= p(z \mid \pi)\prod_{i=1}^{D} p(x_i \mid z, \mu) \\ &= \pi_z \prod_{i=1}^{D} \mu_{iz}^{x_i}(1 - \mu_{iz})^{1-x_i} \end{aligned} \quad \text{Equation 8}$$

Here, the parameter $\pi_z=p(z|\pi)$ denotes the prior probability of the latent variable z, while the parameter $\mu_{iz}=p(x_i=1|z, \mu)$ denotes the conditional means of the observed variable $x_i$.

It is noted that an expectation-maximization (EM) algorithm can be used to estimate parameters that maximize the likelihood $\Pi_n\, p(x_n|\pi, \mu)$ of the visits in the historical patient data. The number of clusters k is determined with Bayesian Information Criterion (BIC). Similar to RBM 148, the BMM 150 is built for the same diagnosis groups for each hospital.

The trained BMM 150 is then applied to detect the missing code for a new visit. Let $e=\{x_{i_1}, \ldots, x_{i_l}\}$ be the new visit vector. In BMM 150, missing codes are inferred by computing the posterior probability $p(m|e=1, \pi, \mu)$ which can be calculated by:

$$p(m \mid e = 1, \pi, \mu) \propto \sum_{z=1}^{k} p(m \mid z, \mu)p(e = 1 \mid z, \mu)p(z \mid \pi) \quad \text{Equation 9}$$

Here, m is the D-l remaining codes that do not exist in the visit. There is no efficient way to maximize the above equation over all $2^{D-l}$ possible ways to complete the visit. Therefore the individual posterior probability $p(x_i=1|e=1)$ is calculated for each possible missing code i. Then all possible missing codes whose posterior probabilities exceed some threshold are recommended.

In the Gaussian Missing Data model (GMD) 152, each patient visit is treated as a binary set (only 0 or 1) corresponding to the charge codes, diagnoses, etc. that are observed. The model then tries to suggest other codes that should be present, as well. Let $x=(x_1, \ldots x_D)$ be the binary vector representing the presence of charge, diagnoses, and procedure codes as well as any other patient visit data. Under the GMD model, x is a Gaussian random vector with mean μ and covariance matrix R. The elements of x are split into two groups: indices where a code is present and indices where a code is not present. Denote the two index sets as S and T, respectively. $R_S$ is the submatrix of R whose rows are in S. Similarly, $\mu_S$, $\mu_T$ are the subvectors of μ whose indices are in S and T, respectively, and $R_{TS}$ is the submatrix of R whose rows are in T and whose columns are in S. Last, y is the vector of observed codes for a particular visit, specifically in this case, a vector of ones whose length is equal to the number of codes in the bill. An estimate of the probability of missing codes is given by:

$$\hat{x}=E\{x|y,\ \mu,\ R\}=R_{TS}R_S^{-1}(y-\mu_S)+\mu_T \qquad \text{Equation 10}$$

An EM technique is used to train an estimate for R and μ from historical data. Informally, the initial estimates for R and μ are the co-occurrence counts between codes and the relative frequency between codes, respectively. In fact, these first estimates produce good results in model scoring without need for further EM steps. Unlike RBM 148 and BMM 150, the GMD model 152 is built for each hospital due to its efficient implementation.

Each patient visit is converted to the binary vector form x. Then the sets S and T are determined in order to select the submatrices $R_{TS}$, $R_S$ and subvectors $\mu_S$, $\mu_T$. The formula above is then evaluated and elements of $\hat{x}$ whose values are close to 1 indicate a probable missing charge code.

A quantity model 136 could be used to detect the partially missing charges for observation hours, surgery hours, anesthesia hours, recovery hours, etc. Although most of the charges need only binary recommendations (i.e. either present or absent), there are several other charges that require quantitative predictions. When a charge is present, but the charged quantity is less than expected, it is an undercharged quantity.

Since many of these quantity variables have multiple charge codes associated with them, a mapping from charge codes to the quantity variables could be created, such as shown in Table 4 below:

TABLE 4

| Hospital ID | Dept | Charge Code | Description | Time in hours |
|---|---|---|---|---|
| | | | Surgery | |
| 804 | 401 | 10223 | LEVEL 1 MAJOR 1ST HR | 1 |
| 804 | 401 | 10224 | LEVEL 1 MAJOR ADD 15 MIN | 0.25 |
| 804 | 401 | 10204 | LEVEL 1 MINOR 1ST HR | 1 |
| 804 | 401 | 10214 | LEVEL 1 MINOR ADD 15 MIN | 0.25 |
| 804 | 401 | 10225 | LEVEL 2 MAJOR 1ST HR | 1 |
| 804 | 401 | 10226 | LEVEL 2 MAJOR ADD 15 MIN | 0.25 |
| 804 | 401 | 10215 | LEVEL 2 MINOR 1ST HR | 1 |
| 804 | 401 | 10216 | LEVEL 2 MINOR ADD 15 MIN | 0.25 |
| | | | Anesthesia | |
| 804 | 422 | 10022 | LEVEL 1 ANES 1ST HR | 1 |
| 804 | 422 | 10023 | LEVEL 1 ANES ADDL 15 MIN | 0.25 |
| 804 | 422 | 10024 | LEVEL 11 ANES 1ST HR | 1 |
| 804 | 422 | 10025 | LEVEL 11 ANES ADDL 15 MIN | 0.25 |
| 804 | 422 | 10018 | LEVEL 111 ANES 1ST HR | 1 |
| 804 | 422 | 10019 | LEVEL 111 ANES ADDL 15 MIN | 0.25 |
| | | | Observation | |
| 804 | 310 | 10013 | DIRECT ADMIT TO OBSERVATION | 1 |
| 804 | 360 | 10013 | DIRECT ADMIT TO OBSERVATION | 1 |
| 804 | 310 | 10047 | OBS COMPLEX DIRECT ADMIT | 1 |
| 804 | 360 | 10047 | OBS COMPLEX DIRECT ADMIT | 1 |
| 804 | 310 | 10045 | OBS MINOR DIRECT ADMIT | 1 |
| 804 | 360 | 10045 | OBS MINOR DIRECT ADMIT | 1 |

TABLE 4-continued

| Hospital ID | Dept | Charge Code | Description | Time in hours |
|---|---|---|---|---|
| 804 | 310 | 10017 | OBS MINOR EA ADD HR | 1 |
| 804 | 360 | 10017 | OBS MINOR EA ADD HR | 1 |
| 804 | 310 | 10025 | OBS/INIT HR MODERATE | 1 |
| 804 | 360 | 10025 | OBS/INIT HR MODERATE | 1 |
| | | | Recovery | |
| 804 | 405 | 32000 | PHASE II RECOVERY PER HOUR | 1 |
| 804 | 408 | 52 | RECOV POST-VAG ½ HR | 0.5 |
| 804 | 404 | 29134 | RECOVERY ROOM 1-30 MIN | 0.5 |
| 804 | 404 | 29139 | RECOVERY ROOM ADD'L 15 MIN | 0.25 |
| 804 | 405 | 10094 | SDS RECOVERY 1ST HR | 1 |
| 804 | 405 | 10095 | SDS RECOVERY ADD 15 MIN | 0.25 |
| 805 | 402 | 5928 | REC ROOM GI LAB 1ST HR | 1 |
| 805 | 402 | 64709 | REC ROOM GI LAB ADD 15 MI | 0.25 |
| 805 | 404 | 21522 | RECOVERY 1ST HOUR | 1 |
| 805 | 404 | 960 | RECOVERY ADD 15 MIN | 0.25 |
| 805 | 404 | 10005 | SDS RECOVERY 1ST HOUR | 1 |
| 805 | 405 | 10094 | SDS RECOVERY 1ST HR | 1 |

Extra fields could be calculated (e.g., stay duration) to better model quantities. The quantity modeling consists of two steps: variable selection and regression. In the variable selection step, the initial dependent set is initialized to the empty set. Incrementally, variables from the pool are added to minimize the mean square residual of the target quantity. This step is repeated until the improvement in terms of residuals is smaller than a threshold. Once the dependent variable is set, a simple linear regression is used to construct a quantitative prediction model to predict quantities. For each model, the residual root mean square error is also noted.

For each quantitative variable, the predicted value is compared to the current value of the variable. If the difference is higher than a threshold (which is a product of mean square error of the model and a pre-decided constant) and the current value is lower than the predicted value, a recommendation is made to increase quantity of this variable.

A cascade model 140 could also be utilized by the system to capture the complicated relationship between codes and to improve prediction accuracy and performance. The first stage of the cascade model is an ensemble model 154 (itself a cascade model) that combines a number of individual models (e.g., supervised learning models 132, joint-density models 134, and/or quantity models 136), and where the second stage is a feedback model 158 which learns the feedback from professional coders. At least one of the individual models used in the ensemble model 154 could utilize a normalization model 156. Any individual model can be used in the ensemble model. Any other suitable model structures can be used as the outpatient model. The remaining features are based on information from the account receiving the code recommendation. Binary indicators are created for variables such as the patient's type, subtype, financial class, and day of week of discharge. A quantity model 136 could be used with, but separate from, the ensemble model 154.

Figure 8:
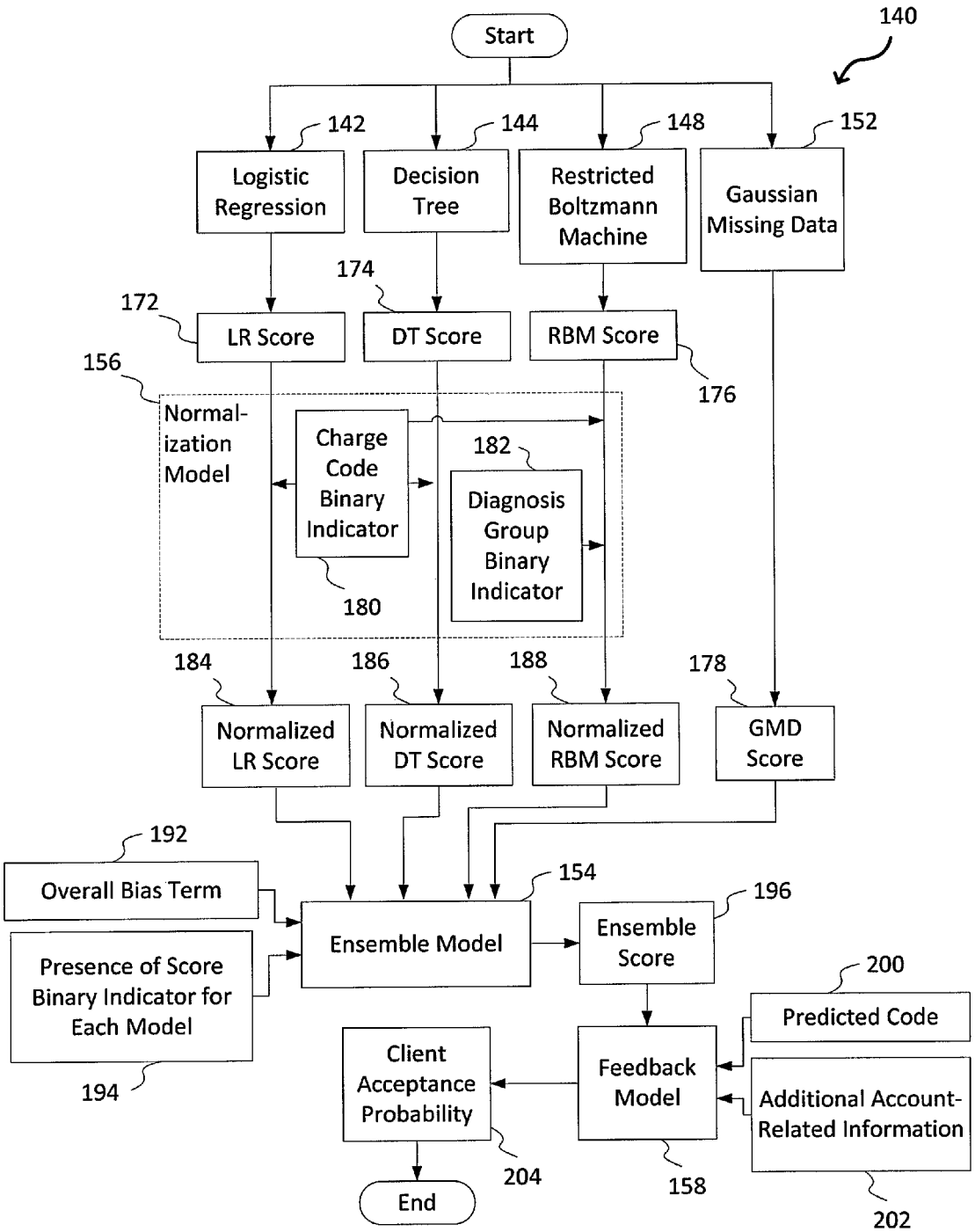
FIG. 8 is a flowchart showing processing steps carried out by the system for detecting billing errors using cascaded predictive models.

FIG. 8 is a flowchart illustrating the cascade model 140 in greater detail. Based on performance and computation load, the cascade model 140 includes a logistic regression (LR) model 142, decision tree (DT) model 144, restricted Boltzmann machine (RBM) model 148, and Gaussian missing data (GMD) model 152. The outputs of the LR models, RBM models, and DT models (i.e., LR score 172, DT score 174, and RBM score 176) need to first be preprocessed by the normalization model 156. The solution comprises several thousand LR 142, DT 144, and RBM 148 models, where the LR 142 and DT 144 models are trained per charge code, and the RBM 148 models are trained per diagnosis group. The normalization model 156 normalizes, or calibrates, the results from any one set of models so that, for example, the output from one RBM model 148 is consistent with the output from another RBM model 148.

The normalization model 156 obtains positive training examples by (1) removing one charge code from a patient visit, (2) scoring the altered visit using the appropriate LR 142, RBM 148, or DT 144 model, saving the (code, score) pair, (3) repeating steps 1-2 for each code in the patient visit, and (4) repeating steps 1-3 for each visit in historical data. Negative examples are created by (1) scoring an unaltered visit using the appropriate LR 142, RBM 148, or DT 144 model, (2) saving the top 100 (code, output) pairs, ordered by score, and (3) repeating 1-2 for each visit in historical data.

For normalizing the LR 142 and DT 144 models, the inputs into the normalization model 156 are the model score (i.e., LR score 172, DT score 174, and RBM score 176) and a binary indicator variable corresponding to the charge code (which is equivalent to the model used). For the RBM normalization, the inputs are the RBM score 176, binary indicator for charge code 180, and binary indicator for diagnosis group 182. The normalization models 156 use the L1-regularized logistic regression model described previously.

Then, normalized LR 184, RBM 188, and DT 186 models (e.g., processed outputs) are joined or combined with the GMD score 178 of the GMD model 152 to form the final ensemble model 154, which uses the L1-regularized logistic regression model described previously.

Positive and negative training examples are created in a similar way as for model normalization, except that the normalized scores are recorded. There are 9 inputs into the ensemble model 154, two per model and one overall bias term 192. The two inputs per model are: (1) normalized scores (i.e., normalized LR score 184, normalized DT score 186, normalized RBM score 188, GMD score 178); and (2) a binary indicator for presence of a score for each model (indicated as 194 in FIG. 8). The indicator 194 acts as the combined bias/penalty associated with having a score from that particular model.

In addition to the ensemble model 154, a second layer model (feedback model 158) is trained to target the feedback received from the client's auditors. The feedback model 158 learns from feedback to further refine the results. For example, if the electrocardiography (EKG) is always delayed for one hospital (which usually triggers the alarm of the ensemble model) the feedback model could learn to suppress it. Logistic regression is used in this implementation, but other classifiers are suitable.

The features used by the feedback model 158 come from either the ensemble model output or from information on the account itself. The predicted code itself is also used, along with several derivative features which aim to take advantage of the partially hierarchical structure of the coding systems. Thus, the model takes as input the predicted code 200, its ensemble score 196 (i.e., ensemble model output), and additional account-related information 202. The output is the probability that the client (or client's auditor) accepts the code, indicated by block 204. If the code predicted is a CPT or HCPCS code (5 characters), then four binary indicator features are activated: an indicator for the full code, plus three indicators for the first one, two, and three characters of the code, respectively. On the other hand, if the code predicted comes from a hospital chargemaster, then only two binary features are activated: an indicator for the full code (3-digit department code+5-digit charge code), plus another indicator for the 3-digit department code alone.

It is noted that the training set could be expanded by tracking the future appearance of a code on a visit as a proxy, which is usually caused by the manual review or the delay of hospital billing systems. That is, predictions are made given a snapshot of the visit data on a past date, and then the correctness of each prediction is judged by the appearance of the predicted code in later days. Also, the feedback model 158 could be biased on delayed codes. For these reasons, examples of real feedback are given higher weight in training than the proxy labels.

In addition to expanding the training set, L1 regularization could be used to prevent over-fitting to noise in the auditor feedback. A parameter search can be used to select the regularization strength and the learning rate of the logistic regression training. Holdout validation can be used to compare the effectiveness of the models, with the models trained on data collected continuously over two months, and then tested on data for the following two weeks. The metric for performance is the false positive rate at 95% recall of positive examples, since this is roughly the target point on the Receiving Operator Characteristic (ROC) curve, but other choices for operating points would also be valid.

Having thus described the invention in detail, it is to be understood that the foregoing description is not intended to limit the spirit or scope thereof. It will be understood that the embodiments of the present invention described herein are merely exemplary and that a person skilled in the art may make any variations and modification without departing from the spirit and scope of the invention. All such variations and modifications, including those discussed above, are intended to be included within the scope of the invention. What is desired to be protected is set forth in the following claims.

What is claimed is:

1. A system for detecting billing errors using artificial intelligence comprising:

a computer system in communication with a billing client, said computer system electronically receiving and processing billing information electronically gathered by the billing client over a pre-defined period of time, said computer system configured to include an artificial neural network having an input layer, a plurality of processing elements, and an output layer;

a billing history database in communication with the computer system and storing the billing information, the computer system processing the billing information to select one or more data fields of the billing information; and a billing error detection engine executed by the computer system, said detection engine processing the one or more data fields using one or more predictive models to detect, score, and flag potential billing errors in the billing information, the billing error detection engine executing the following steps:

a feedback model so that the computer system learns relationships between billing codes present in the billing information, an inpatient model that targets low charges and high charges in inpatient data by filtering for each Diagnosis Related Groups (DRG) the number of visits within a pre-defined threshold and then applying a Principal Component Analysis (PCA) Module to calculate and compare a department-hospital level average with a reconstructed value for new visits, the inpatient model utilizing said artificial neural network of said computer system, said artificial neural network reconstructing charge values and flagging actual charge values for review if a difference between the reconstructed charge value and the actual charge value is above a threshold an outpatient model that detects missing codes in outpatient data by applying a supervised learning model to learn the probability of a presence of a code using a logistic regression (LR) model for each code to be evaluated, and applying a Decision Tree (DT) model to capture non-linearity between data and their codes and to take into account multiple hospitals, applying a joint-density learning model to learn interdependencies between visit data using a Restricted Boltzmann Machine (RBM) model to compute whether a code should be present and a probability of missing charges, and applying a Gaussian Missing Data (GMD) model to suggest other codes that should be present; and executing a cascade model to capture relationship between codes and improve prediction accuracy and performance by (i) applying a normalization model to pre-process outputs of the LR model, the DT model, and the RBM model to calibrate the outputs for consistency, (ii) applying an ensemble model to combine the LR model, the DT model, the RBM model, and the GMD model to generate an ensemble score, and (iii) applying a feedback model to further refine results by receiving as input a predicted code and an ensemble score to generate a probability of code acceptance;

wherein the computer system transmits the flagged potential billing errors to the billing client for review.

2. The system of claim 1, wherein the billing error detection engine determines whether review by an auditor of the flagged potential billing errors is required, and if a positive determination is made, electronically transmits the flagged errors to an auditor.

3. The system of claim 2, wherein, prior to transmission of the flagged potential billing errors to the billing client, the billing error detection engine updates the flagged billing errors based on auditor feedback.

4. The system of claim 1, wherein the billing error detection engine creates a scored action list based on scores generated by the one or more predictive models to prioritize amounts and likelihoods associated with the flagged billing errors.

5. The system of claim 1, wherein the inpatient model includes an Auto-Encoder Model.

6. The system of claim 1, wherein the outpatient model includes at least one of a Supervised Learning Model, or a Quantity Model.

7. The system of claim 1, wherein the Cascade Model includes at least one of a Supervised Learning Model, or a Quantity Model.

8. A method for detecting billing errors using artificial intelligence comprising:

electronically receiving and processing billing information by a computer system in communication with a billing client, said billing information electronically gathered by the billing client over a pre-defined period of time, said computer system configured to include an artificial neural network having an input layer, a plurality of processing elements, and an output layer;

processing the billing information by the computer system to select one or more data fields of the billing information;

storing the billing information in a billing history database in communication with the computer system;

executing by the computer system a billing error detection engine to process the one or more data fields using one or more predictive models of the billing error detection engine to detect, score, and flag potential billing errors in the billing information;

executing, by the billing error detection engine, a feedback model so that the computer system learns relationships between billing codes present in the billing information;

executing, by the billing error detection engine, an inpatient model that targets low charges and high charges in inpatient data by filtering for each Diagnosis Related Groups (DRG) the number of visits within a predefined threshold and then applying a Principal Component Analysis (PCA) Module to calculate and compare a department-hospital level average with a reconstructed value for new visits, the inpatient model utilizing said artificial neural network of said computer system, said artificial neural network reconstructing charge values and flagging actual charge values for review if a difference between the reconstructed charge value and the actual charge value is above a threshold;

executing, by the billing error detection engine, an outpatient model that detects missing codes in outpatient data by applying a supervised learning model to learn the probability of a presence of a code using a logistic regression (LR) model for each code to be evaluated, and applying a Decision Tree (DT) model to capture non-linearity between data and their codes and to take into account multiple hospitals;

applying, by the billing error detection engine, a joint-density learning model to learn interdependencies between visit data using a Restricted Boltzmann Machine (RBM) model to compute whether a code should be present and a probability of missing charges, and applying a Gaussian Missing Data (GMD) model to suggest other codes that should be present; and executing, by the billing error detection engine, a cascade model to capture relationship between codes and improve prediction accuracy and performance by (i) applying a normalization model to pre-process outputs of the LR model, the DT model, and the RBM model to calibrate the outputs for consistency, (ii) applying an ensemble model to combine the LR model, the DT model, the RBM model, and the GMD model to generate an ensemble score, and (iii) applying a feedback model to further refine results by receiving as input a predicted code and an ensemble score to generate a probability of code acceptance;

transmitting the flagged potential billing errors to the billing client for review.

9. The method of claim 8, further comprising determining by the billing error detection engine whether review by an auditor of the flagged potential billing errors is required, and if a positive determination is made, electronically transmitting the flagged errors to an auditor.

10. The method of claim 9, further comprising updating by the billing error detection engine the flagged billing errors based on auditor feedback prior to transmitting the flagged potential billing errors to the billing client.

11. The method of claim 8, further comprising creating by the billing error detection engine a scored action list based on scores generated by the one or more predictive models to prioritize amounts and likelihoods associated with the flagged billing errors.

12. The method of claim 8, wherein the inpatient model includes an Auto-Encoder Model.

13. The method of claim 8, wherein the outpatient models includes at least one of a Supervised Learning Model, a Joint Density Learning Model, or a Quantity Models.

14. The method of claim 9, wherein the Cascade Model includes at least one of a Supervised Learning Model, or a Quantity Model.

15. A non-transitory computer-readable medium having computer-readable instructions stored thereon which, when executed by a computer system, cause the computer system to detect billing errors using artificial intelligence by performing the steps of:

electronically receiving and processing billing information by a computer system in communication with a billing client, said billing information electronically gathered by the billing client over a pre-defined period of time, said computer system configured to include an artificial neural network having an input layer, a plurality of processing elements, and an output layer;

processing the billing information by the computer system to select one or more data fields of the billing information;

storing the billing information in a billing history database in communication with the computer system;

executing by the computer system a billing error detection engine to process the one or more data fields using one or more predictive models of the billing error detection engine to detect, score, and flag potential billing errors in the billing information;

executing, by the billing error detection engine, a feedback model so that the computer system learns relationships between billing codes present in the billing information;

executing, by the billing error detection engine, an inpatient model that targets low charges and high charges in inpatient data by filtering for each Diagnosis Related Groups (DRG) the number of visits within a predefined threshold and then applying a Principal Component Analysis (PCA) Module to calculate and compare a department-hospital level average with a reconstructed value for new visits, the inpatient model utilizing said artificial neural network of said computer system, said artificial neural network reconstructing charge values and flagging actual charge values for review if a difference between the reconstructed charge value and the actual charge value is above a threshold;

executing, by the billing error detection engine, an outpatient model that detects missing codes in outpatient data by applying a supervised learning model to learn the probability of a presence of a code using a logistic regression (LR) model for each code to be evaluated, and applying a Decision Tree (DT) model to capture non-linearity between data and their codes and to take into account multiple hospitals;

applying, by the billing error detection engine, a joint-density learning model to learn interdependencies between visit data using a Restricted Boltzmann Machine (RBM) model to compute whether a code should be present and a probability of missing charges, and applying a Gaussian Missing Data (GMD) model to suggest other codes that should be present; and executing, by the billing error detection engine, a cascade model to capture relationship between codes and improve prediction accuracy and performance by (i) applying a normalization model to pre-process outputs of the LR model, the DT model, and the RBM model to calibrate the outputs for consistency, (ii) applying an ensemble model to combine the LR model, the DT model, the RBM model, and the GMD model to generate an ensemble score, and (iii) applying a feedback model to further refine results by receiving as input a predicted code and an ensemble score to generate a probability of code acceptance;

transmitting the flagged potential billing errors to the billing client for review.

16. The computer-readable medium of claim 15, further comprising determining by the billing error detection engine whether review by an auditor of the flagged potential billing errors is required, and if a positive determination is made, electronically transmitting the flagged errors to an auditor.

17. The computer-readable medium of claim 16, further comprising updating by the billing error detection engine the flagged billing errors based on auditor feedback prior to transmitting the flagged potential billing errors to the billing client.

18. The computer-readable medium of claim 15, further comprising creating by the billing error detection engine a scored action list based on scores generated by the one or more predictive models to prioritize amounts and likelihoods associated with the flagged billing errors.

19. The computer-readable medium of claim 15, wherein the inpatient model includes an Auto-Encoder Model.

20. The computer-readable medium of claim 15, wherein the outpatient models includes at least one of a Supervised Learning Model, or a Quantity Model.

21. The computer-readable medium of claim 15, wherein the Cascade Model includes at least one of a Supervised Learning Model, or a Quantity Model.

* * * * *